US009038929B1

(12) United States Patent
Commette

(10) Patent No.: US 9,038,929 B1
(45) Date of Patent: May 26, 2015

(54) AIR SPRAY GUN WITH PATTERN CONTROL TIP

(75) Inventor: Denis S. Commette, Mantoloking, NJ (US)

(73) Assignee: PMC, INC., Sun Valley, CA (US)

( * ) Notice: Subject to any disclaimer, the term of this patent is extended or adjusted under 35 U.S.C. 154(b) by 418 days.

(21) Appl. No.: 13/467,343

(22) Filed: May 9, 2012

Related U.S. Application Data

(60) Provisional application No. 61/498,193, filed on Jun. 17, 2011.

(51) Int. Cl.

| | |
|---|---|
| ***B05B 7/02*** | (2006.01) |
| ***B05B 7/04*** | (2006.01) |
| ***B05B 9/01*** | (2006.01) |
| ***B05B 15/02*** | (2006.01) |
| *B05B 7/00* | (2006.01) |

(52) U.S. Cl.
CPC ..... *B05B 7/04* (2013.01); *B05B 7/0018* (2013.01); *B05B 15/025* (2013.01); *B05B 7/0408* (2013.01); *B05B 7/02* (2013.01); *B05B 9/01* (2013.01)

(58) Field of Classification Search
CPC ..... B05B 9/01; B05B 15/02; B05B 15/0208; B05B 15/025; B05B 15/0258; B05B 7/0018; B05B 7/0025; B05B 7/0031; B05B 7/02; B05B 7/04; B05B 7/0408
USPC ..... 239/106, 110, 112, 413–414, 416.1, 239/525–527
See application file for complete search history.

(56) References Cited

U.S. PATENT DOCUMENTS

| | | | | |
|---|---|---|---|---|
| 2,890,836 | A | 6/1959 | Gusmer et al. | |
| 3,263,928 | A | 8/1966 | Gusmer | |
| 3,627,275 | A | 12/1971 | Gusmer | |
| 3,765,605 | A | 10/1973 | Gusmer et al. | |
| 3,799,403 | A * | 3/1974 | Probst et al. | 222/135 |
| 3,837,575 | A * | 9/1974 | Lehnert | 239/112 |
| 3,876,145 | A | 4/1975 | Gusmer et al. | |
| 4,377,256 | A | 3/1983 | Commette et al. | |
| 4,427,153 | A * | 1/1984 | Schaefer | 239/117 |
| 4,523,696 | A | 6/1985 | Commette et al. | |
| 4,925,104 | A * | 5/1990 | Smith | 239/71 |
| 6,634,570 | B2 * | 10/2003 | Scherer | 239/117 |
| 6,796,461 | B1 * | 9/2004 | Sinders | 222/135 |
| 7,527,172 | B2 * | 5/2009 | McMichael | 222/145.5 |
| 2007/0034716 | A1 * | 2/2007 | Zittel et al. | 239/296 |
| 2011/0101129 | A1 * | 5/2011 | Anderson et al. | 239/310 |

* cited by examiner

*Primary Examiner* — Darren W Gorman
(74) *Attorney, Agent, or Firm* — Frost Brown Todd LLC

(57) ABSTRACT

A spray gun includes a main piston chamber having an actuatable piston and a gun block. The gun block includes a mixing chamber that has a pair of impingement holes that each tangentially intersects with an exit hole of the mixing chamber at opposing tangential points. The gun block also includes a tip that is coupled to an end of the mixing chamber and has a pattern channel that is substantially axially aligned with the exit hole of the mixing chamber. The length of the pattern channel is less than the length of the exit hole of the mixing chamber. In some versions, the ratio of the pattern channel to the combined length of the pattern channel and exit hole can be between 31%, inclusive, and 5%, inclusive. A selectively coupleable handle may be provided such that users can utilize different handles with the spray gun.

20 Claims, 10 Drawing Sheets

AIR SPRAY GUN WITH PATTERN CONTROL TIP

PRIORITY

This application claims priority from the disclosure of U.S. Provisional Patent Application Ser. No. 61/498,193, having the same title, filed on Jun. 17, 2011, the disclosure of which is incorporated by reference herein.

BACKGROUND

Applying polyurethane foam or other elastomeric coatings may be accomplished by mixing mutually reactive fluids to form a foam that can cure on a substrate when the one or more fluids combine. Various devices and apparatuses have been developed to accomplish this application of foam, including spray guns. Merely exemplary spray guns and components are disclosed in U.S. Pat. No. 2,890,836, entitled "Apparatus for Applying a Mixture of a Plurality of Liquids," issued Jun. 16, 1959; U.S. Pat. No. 3,263,928, entitled "Apparatus for Ejecting a Mixture of Liquids," issued Aug. 2, 1966; U.S. Pat. No. 3,627,275, entitled "Apparatus for Producing Plastic Foam," issued Dec. 14, 1971; U.S. Pat. No. 3,765,605, entitled "Apparatus for Ejecting a Mixture of Liquids," issued Oct. 16, 1973; U.S. Pat. No. 3,876,145, entitled "Apparatus for Ejecting a Mixture of Plurality of Liquids," issued Apr. 8, 1975; U.S. Pat. No. 4,377,256, entitled "Apparatus for Dispensing a Mixture of Mutually Reactive Liquids," issued Mar. 22, 1983; U.S. Pat. No. 4,523,696, entitled "Apparatus for Dispensing a Mixture of Mutually Reactive Liquids," issued Jun. 18, 1985; and U.S. Pat. No. 7,527,172, entitled "Plural Component Mixing and Dispensing Apparatus," issued May 5, 2009. The disclosure of each of the above-cited U.S. Patents is incorporated by reference herein.

In certain situations it may be preferable to a user of a spray gun to have an air purgeable mixing chamber to clear out any residual mixed fluids to prevent clogging. In such guns, compressed air may be used to actuate an air piston between a dispensing position and a purging position. Furthermore, a user may find it preferable to include a pattern control tip such that the expelled mixed solution may be applied in different patterns. Such pattern control tips may also be preferably removable in such a manner that a user can substitute different pattern control tips quickly.

While several systems and methods have been made and used for spray guns, it is believed that no one prior to the inventor has made or used the invention described in the appended claims.

BRIEF DESCRIPTION OF THE DRAWINGS

While the specification concludes with claims which particularly point out and distinctly claim this technology, it is believed this technology will be better understood from the following description of certain examples taken in conjunction with the accompanying drawings, in which like reference numerals identify the same elements and in which:

Figure 1:
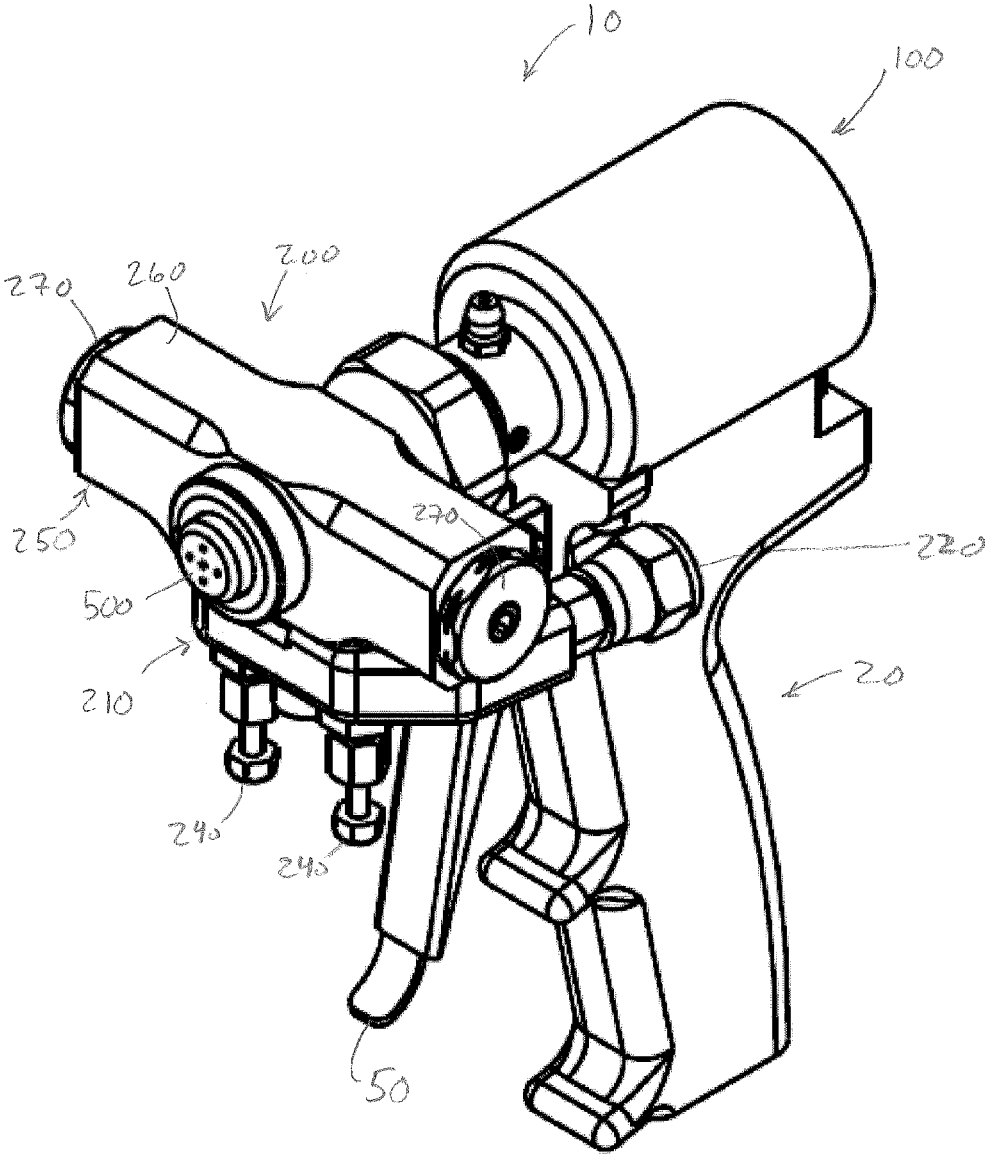
FIG. 1 depicts an isometric view of an exemplary spray gun.

The drawings are not intended to be limiting in any way, and it is contemplated that various embodiments of the technology may be carried out in a variety of other ways, including those not necessarily depicted in the drawings. The accompanying drawings incorporated in and forming a part of the specification illustrate several aspects of the present technology, and together with the description serve to explain the principles of the technology; it being understood, however, that this technology is not limited to the precise arrangements shown.

DETAILED DESCRIPTION

The following description of certain examples of the technology should not be used to limit its scope. Other examples, features, aspects, embodiments, and advantages of the technology will become apparent to those skilled in the art from the following description, which is by way of illustration, one of the best modes contemplated for carrying out the technology. As will be realized, the technology described herein is capable of other different and obvious aspects, all without departing from the technology. Accordingly, the drawings and descriptions should be regarded as illustrative in nature and not restrictive.

I. Overview

Figure 2:
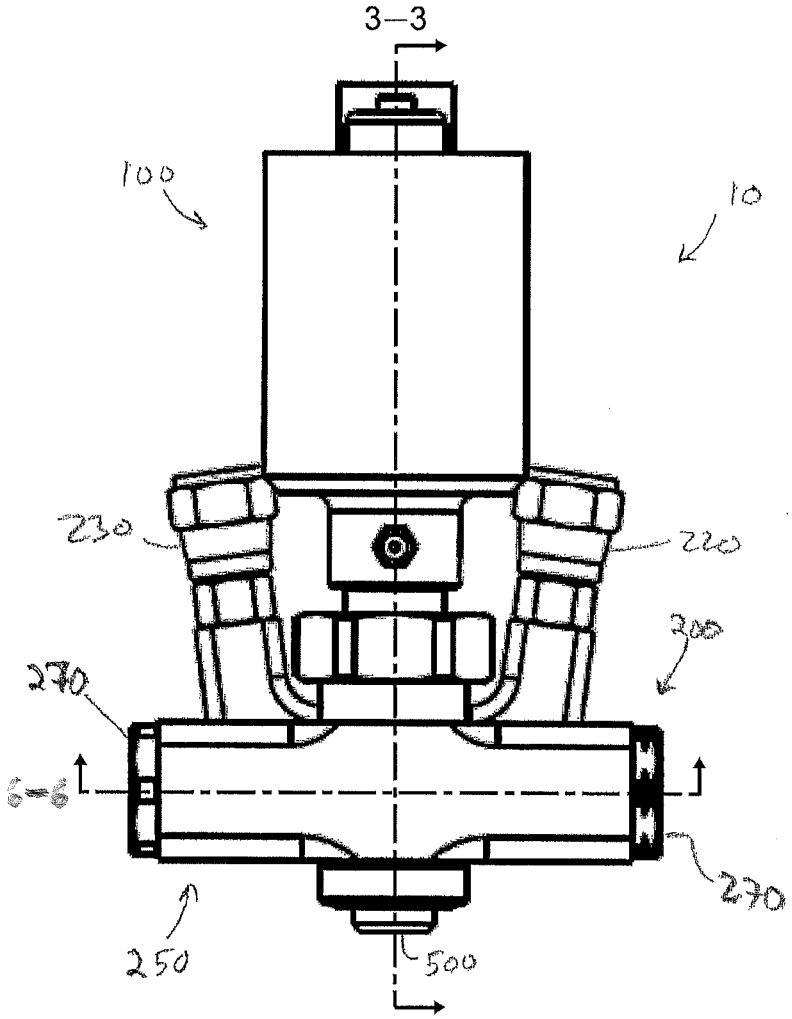
FIG. 2 depicts a top view of the exemplary spray gun of FIG. 1.
Figure 3:
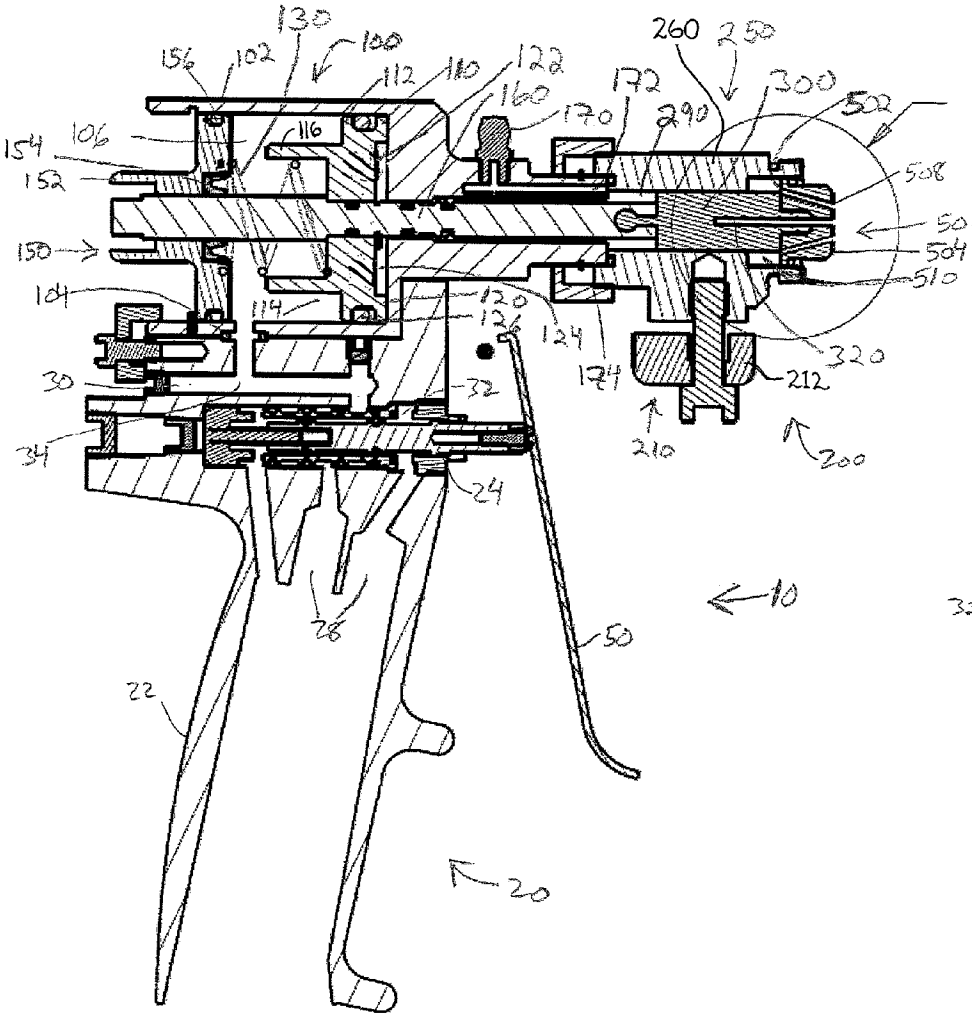
FIG. 3 depicts a side cross-sectional view of the spray gun of FIG. 1 along section 3-3 in FIG. 2.

FIGS. 1-3 show an exemplary spray gun (10) having a handle (20), a piston chamber (100), a trigger (50), and a gun block (200). Trigger (50) is pivotally coupled to handle (20) such that trigger (50) may be pivoted from a first position, in which spray gun (10) is not activated, to a second position, in which spray gun (10) is activated to expel a mixed material. Handle (20) comprises an inlet (28) to which a compressed fluid source may be coupled. As used herein, the term "fluid" refers to any is a substance that continually deforms (or flows) under an applied shear stress, no matter how small. Such fluids may include liquids, gases, plasma and/or plasticized solids or any combination thereof. Piston chamber (100) of the present example is mounted above handle (20) and is configured to contain a main piston (110) that may actuate a mixing chamber (300) from a first, purging or inactive position, to a second, dispensing position, as will be described in greater detail below. Piston chamber (100) is further configured to be in fluid communication with a plurality of channels (30) contained within handle (20) via a spool valve (24) such that compressed air or other fluid may travel between handle (20) and piston chamber (100). Gun block (200) extends distally from piston chamber (100), and gun block (200) is coupled to piston chamber (100). Gun block (200) of the present example comprises a bottom portion (210) and a top portion (250). Bottom portion (210) comprises a first component inlet (220), a second component inlet (230), and a pair of manual inlet valves (240). First and second component inlets (220, 230) extend proximally from bottom portion (210). Top portion (250) comprises a top body portion (260), a pair of spring compression valves (270), a mixing chamber (300), and a pattern control tip (500). In brief, pattern control tip (500) is coupled to mixing chamber (300) and is configured to dispense a mixed material from mixing chamber (300) with a predetermined pattern.

In brief, a first fluid source is coupled to the first component inlet (220) and a second fluid source is coupled to the second component inlet (230). A compressed fluid source, such as compressed air, is coupled to inlet (28) of handle (20). When trigger (50) is pivoted to activate spool valve (24), the compressed air forces main piston (110) in a proximal direction to actuate mixing chamber (300) into the dispensing position, shown best in FIG. 6, thereby aligning impingement holes (310) with spring compression valves (270) such that the first and second fluid sources may enter mixing chamber (300), mix together, and be expelled out distally from spray gun (10). Thus, the mixed first and second components may be sprayed from the distal end of spray gun (10) when in use.

II. Exemplary Handle

Figure 5:
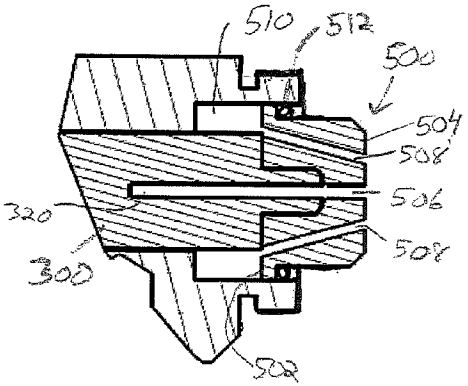
FIG. 5 depicts an enlarged cross-sectional view of an exemplary mixing chamber and pattern control tip of FIG. 3.

Referring now to FIG. 3, handle (20) comprises a handle body (22), a spool valve (24) disposed within handle body (22), a plurality of channels (30) formed within handle body (22), and an inlet (28). Trigger (50) is pivotally coupled to a distal portion of handle body (22). Initially, with trigger (50) in the first position, spool valve (24) is in a first position where inlet (28) is in fluid communication with a first set of channels (32) of the plurality of channels (30) such that the fluid coupled to inlet (28) travels through a flow path in spray gun (10) to a mixing chamber compartment (290). When mixing chamber (300) is in the first, purging or inactive position, impingement holes (310) (shown in FIGS. 6-9) are exposed within mixing chamber compartment (290) and the fluid from inlet (28) flows through impingement holes (310), through mixing exit hole (320) and out through pattern control tip (500). Thus, when a compressed air source is coupled to inlet (28), compressed air purges mixing exit hole (320) and pattern control tip (500) when trigger (50) and spool valve (24) are in the first position. In addition, a forwardmost compartment (510) provides fluid communication between mixing member compartment (290) and a proximal end (502) of pattern control tip (500). If pattern control tip (500), as will be described later herein in more detail, has purge channels (508), as best seen in FIG. 5, then the compressed air from inlet (28) may also flow through purge channels (508) to force compressed air over a distal end (504) of pattern control tip (500).

When trigger (50) is pivotally depressed by a user, spool valve (24) is slidably actuated from the first position to a second position, thereby resulting in fluid communication between inlet (28) and second set of channels (34) of the plurality of channels (30) such that the fluid from inlet (28) travels to piston chamber (100) to activate main piston (110), as will be described in more detail herein. Main piston (110) actuates mixing chamber (300) to the second, dispensing position, thereby aligning impingement holes (310) with spring compression valves (270) (shown in FIG. 1-2) to permit fluid communication from first and second sources into mixing chamber (300). First and second sources mix and are expelled from spray gun (10).

While one merely exemplary configuration for handle (20) has been described, yet other equally suitable configurations will be apparent to one of ordinary skill in the art in view of the teachings herein. Indeed, inlet (28) need not be positioned within handle. Inlet (28) may instead be coupled to piston chamber (100) or gun block (200). In addition, spool valve (24) may be configured to provide fluid communication to more than the two above configurations. For instance, spool valve (24) may be configured to be a three-position valve such that a third configuration may be provided. By way of example only, the second and third positions may be substantially similar to the configuration described above. In this configuration, the first position of spool valve (24) may be configured to substantially block inlet (28) or to vent the fluid from inlet out a vent (not shown) in handle (22) such that no compressed air flows into any of the plurality of channels (30). Thus, spray gun (10) is inactive in the first position, purges mixing chamber (300) and pattern control tip (500) in the second position, and dispenses the mixture of first and second sources in the third position. In another alternative, the third configuration may be substantially similar to the first configuration previously described above such that when a user depresses trigger (50) beyond the second position to a third position, compressed air purges mixing chamber (300) and pattern control tip (500). Yet other configurations will be apparent to one of ordinary skill in the art in view of the teachings herein.

III. Exemplary Piston Chamber

Still referring to FIG. 3, exemplary piston chamber (100) comprises a piston chamber body (102), a main piston (110), a piston cavity (106), a chamber cap (150), a piston-chamber link (160), and a piston return spring (130). Piston chamber body (102) may be integrally formed with handle (20) or piston chamber body (102) may be a separate component that is coupled to handle (20). In the present example, piston chamber body (102) mechanically couples to handle (20). Seals (104) are provided to fluidly seal the plurality of channels (30) of handle (20) to piston chamber body (102). Piston chamber body (102) defines piston cavity (106) within which main piston (110) may actuate from a first position to a second position. Chamber cap (150) is insertable into piston cavity (106) on the proximal end to seal main piston (110) within piston cavity (106). Chamber cap (150) comprises a cap body (152), a piston-chamber link seal (154) and an o-ring (156). An aperture formed axially through cap body (152) permits piston-chamber link (160) to actuate axially through the center of cap body (152). Piston-chamber link seal (154) is provided about a proximal portion of piston-chamber link (160) to fluidly seal chamber cap (150) while piston-chamber link (160) actuates between first and second positions. By way of example only, piston-chamber link seal (154) may be a domed seal, a duck bill seal, a combination domed duck bill seal, or any other suitable seal. O-ring (156) is provided about the circumference of cap body (152) to provide a fluid seal when chamber cap (150) is coupled to piston chamber body (102). In the present example, chamber cap (150) is configured to be a circular shaped member for use with a cylindrical piston chamber, though other shapes and configurations will be apparent to one of ordinary skill in the art in view of the teachings herein.

Main piston (110) is disposed within the enclosed chamber formed by piston chamber body (102) and chamber cap (150). In the present example, main piston (110) comprises a piston body (112) and an o-ring (126) disposed about the circumference of piston body (112). Piston body (112) further comprises a proximal end (114) and a distal end (120). Distal end (120) comprises a piston face recess (122) forming an expansion compartment (124). When a fluid from inlet (28) is forced into expansion compartment (124) via second set of channels (34) of the plurality of channels (30), the fluid, such as compressed air, actuates main piston (110) distally against piston return spring (130). Proximal end (114) may comprises a proximal protrusion (116). Proximal protrusion (116) is configured to act as a physical stop to abut against chamber cap (150) when main piston (110) is actuated proximally. The size of proximal protrusion (116) is such that when proximal protrusion (116) abuts chamber cap (150), impingement holes (310) of mixing chamber (300) are aligned with spring compression valves (270). Proximal protrusion (116) may further be configured to retain a distal portion of piston return spring (130) within a cylindrical recess defined by proximal protrusion (116). The proximal end of piston return spring (130) abuts chamber cap (150) such that piston return spring (130) is compressible between chamber cap (150) and main piston (110). Accordingly, when main piston (110) is forced back by the fluid from inlet (28), piston return spring (130) is compressed. When the fluid from inlet (28) ceases, piston return spring (130) is configured such that main piston (110) is forced distally back to main piston's (110) original position. O-ring (126) is provided to form a fluid seal about main piston (110).

Figure 4:
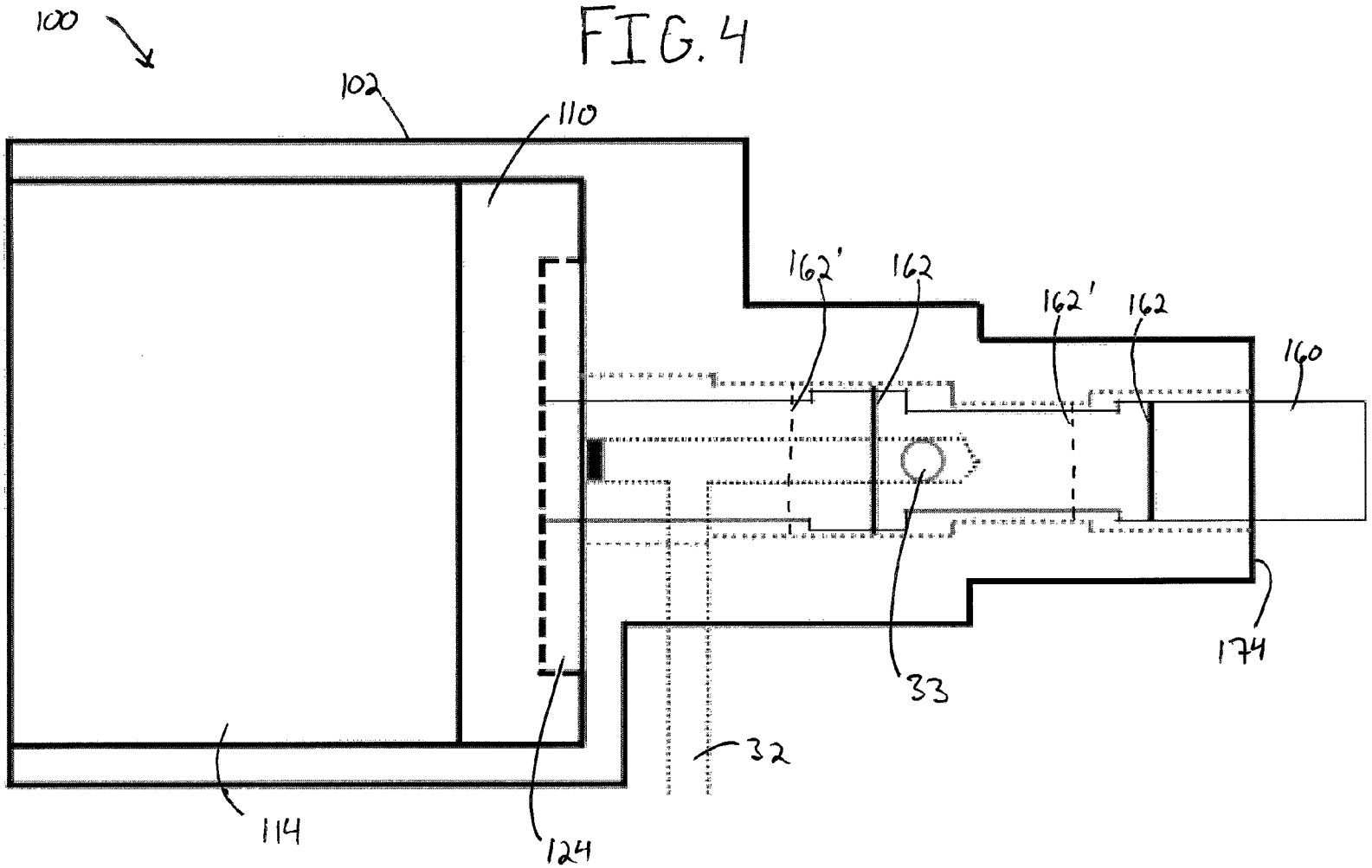
FIG. 4 depicts a schematic side view of a piston chamber for the spray gun of FIG. 1.

Main piston (110) is coupled to piston-chamber link (160). For example, main piston (110) and piston-chamber link (160) may be of unitary construction or main piston (110) and piston-chamber link (160) may be distinct components that are mechanically and/or chemically coupled, such as by threading, compression fitting, set screws, adhesives, and/or any combination of other coupling methods. As can be seen from FIG. 3, piston-chamber link (160) extends from chamber cap (150) to mixing chamber (300), with main piston disposed about piston-chamber link (160). In other configurations, piston-chamber link (160) may only extend from distal end (120) of main piston (110) to mixing chamber (300). As shown schematically in FIG. 4, piston-chamber link (160) comprises o-rings (162) (shown as (162) when trigger (50) is in the initial position and (162') when trigger (50) is pivotally depressed) disposed about portions of piston-chamber link (160). An opening (33) from first set of channels (32) is positioned along the path of piston-chamber link (160) such that when o-rings (162) are in the first position, the compressed fluid may travel radially about piston-chamber link (160) and distal o-ring (162), but cannot travel proximally past second o-ring (162). Accordingly, compressed air is permitted to flow past distal o-ring (162) into mixing member compartment (290) to purge mixing chamber (300) and pattern control tip (500). When piston-chamber link (160) is actuated proximally by main piston (110), o-rings shift proximally to positions designated by references (162'). Thus, air that travels through first set of channels (32) is contained between o-rings (162') and is unable to enter mixing member compartment (290).

Referring back to FIG. 3, a zerk fitting (170) is provided in piston body (112) near the distal end of piston-chamber link (160), though it should be understood that zerk fitting (170) is merely optional. Piston body (112) may have a lubrication compartment (172) such that lubrication may be applied through zerk fitting (170) and lubricate piston-chamber link (160) to reduce wear and friction between piston-chamber link (160) and piston body (112). The lubrication may also flow out a distal opening (174) in piston body (112) into gun block (200) to provide lubrication to mixing chamber (300), as will be described in more detail below.

While one exemplary configuration for piston chamber (100) has been described, still other equally suitable configurations for piston chamber (100) may be provided as will be apparent to one of ordinary skill in the art in view of the teachings herein. For instance, a second piston chamber may be provided such that two main pistons are coupled to piston-chamber link (160).

IV. Exemplary Gun Block

Figure 6:
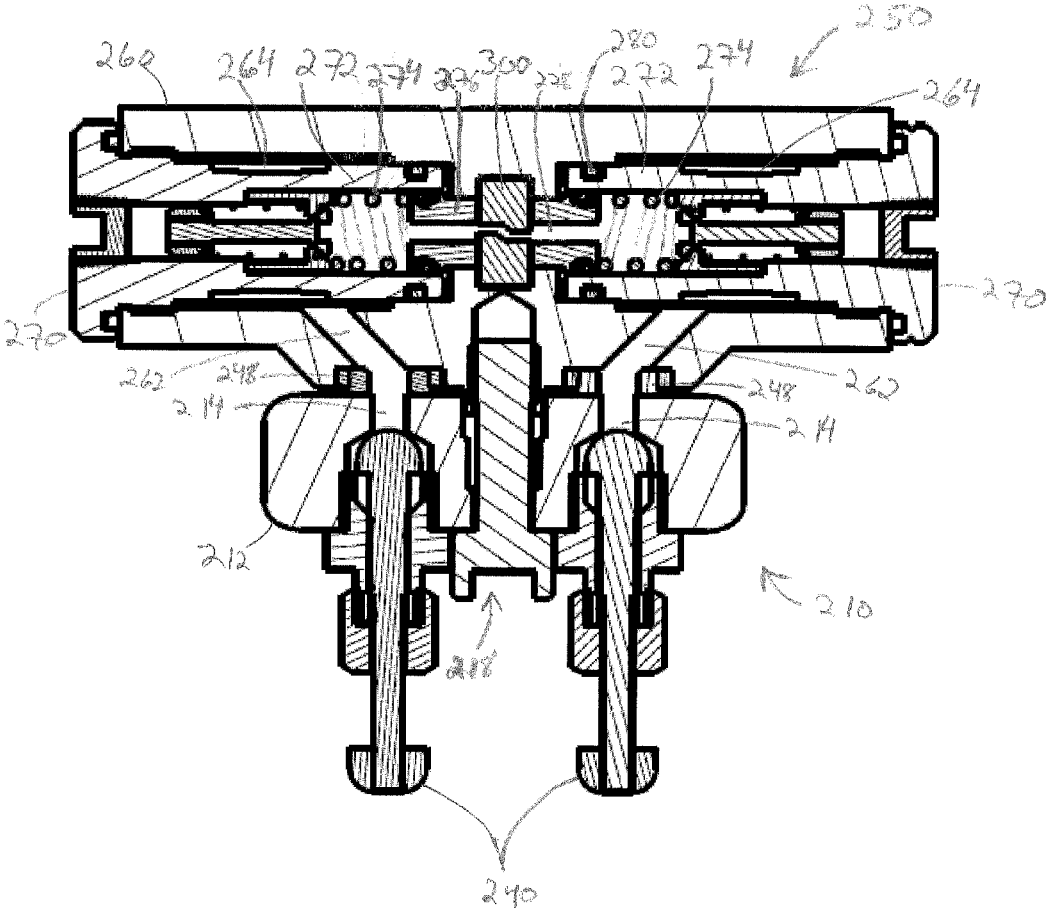
FIG. 6 depicts a front cross-sectional view of the spray gun of FIG. 1 along section 6-6 in FIG. 2 showing the mixing chamber in a dispensing position.

Still referring to FIG. 3, gun block (200) is coupled to the distal end of piston body (112). As described previously, gun block (200) comprises a bottom portion (210) and a top portion (250). Bottom portion (210) comprises a bottom body (212), a first component inlet (220) (shown in FIG. 1-2), a second component inlet (230) (shown in FIG. 1-2), and a pair of manual inlet valves (240), as best seen in FIG. 6. First and second component inlets (220, 230) extend proximally from bottom portion (210) and are configured to couple to a first and second source, respectively. First and second sources may provide components which, when combined, form a polyurethane, though other fluid sources and/or combinations or outputs may be used. Referring to FIG. 6, bottom body (212) comprises channels (214) extending from first and second component inlets (220, 230), past manual inlet valves (240), and into corresponding channels (262) of top portion (250). Bottom portion (210) of the present example is mechanically coupled to top portion (250) by way of a threaded attachment member (218), though it should be understood that bottom and top portion (210, 250) may be integrally formed or may be coupled together through other equally suitable mechanical attachments. Combination seal and ball check valves (248) are provided between bottom portion (210) and top portion (250) around the interface of the channels (214, 262) to provide a fluid seal. In addition, combination seal and ball check valves (248) may also prevent foam from entering an attached hose if an inadvertent crossover occurs. Manual inlet valves (240) are configured to selectively close off channels (262) to reduce the flow of first and/or second source. Thus, a user may have some control over the flow of the first and second sources into spray gun (10).

Top portion (250) comprises a top body portion (260), a pair of spring compression valves (270), and a mixing chamber (300) disposed within a mixing chamber compartment (290). Top body portion (260) comprises channels (262) that extend and are in fluid communication with a pair of valve compartments (264). Each spring compression valve (270) is inserted into a corresponding valve compartment (264) and coupled to top body portion (260). For instance, spring compression valves (270) may be threaded into threads formed in top body portion (260). Each spring compression valve (270) of the present example comprises a valve body (272), a valve spring (274), and an end member (276). One or more o-rings (280) may be provided about portions of valve body (272) to fluidly seal spring compression valve (270) to top body portion (260). Valve spring (274) is disposed within a cavity in valve body (272) and abuts against end member (276). Thus, in the configuration shown in FIG. 6, valve spring (274) urges end member (276) away from valve body (272) and towards mixing chamber (300). Valve body (274) further comprises apertures formed within valve body (274), thereby permitting fluid communication from channels (262) into the interior of valve body (272). End member (276) comprises an axial hole (278) through which fluid within valve body (274) may be communicated towards mixing chamber (300).

When trigger (50), described above, is not depressed, and therefore fluid from inlet (28) has not actuated main piston (110), impingement holes (310) (shown best in FIG. 7) of mixing chamber (300) are located distal of axial hole (278). However, when axial hole (278) and impingement holes (310) are not aligned, end member (276) remains compressed against a side (304) of mixing chamber (300). Thus, side (304) prevents fluid from within valve body (272) from entering into mixing chamber compartment (290) (shown in FIG. 3) due to the compression provided by valve spring (274) on end member (276) against side (304). When trigger (50) is depressed, thereby actuating main piston (110) proximally, mixing chamber (300) actuates proximally via piston-chamber link (160) to a position where impingement holes (310) align with axial holes (278). When pressurized first and second fluid sources are coupled to first and second component inlets (220, 230), fluid passes from each respective valve body (274), through axial holes (278), and into mixing chamber (300) via impingement holes (310). Thus, when trigger (50) is pivotally depressed, the source fluids enter mixing chamber to mix and expel from spray gun (10).

Referring back to FIG. 3, top body portion (260) comprises a mixing chamber compartment (290) and forwardmost compartment (510) that are in fluid communication with the first set of channels (32) of the plurality of channels (30) such that the fluid from inlet (28) enters mixing chamber compartment (290) and forwardmost compartment (510) when trigger (50) of the present example is in the first position. Mixing chamber compartment (290) may be sized slightly larger than mixing chamber (300) such that fluid from the first set of channels (32) may pass around the exterior of mixing chamber (300), or, alternatively, mixing chamber compartment (290) may comprise ports (not shown) that align with impingement holes (310) and are in fluid communication with the first set of channels (32) when trigger (50) is not depressed and mixing chamber is in the first, purging position. Forwardmost compartment (510) of the present example is formed distally of mixing chamber compartment (290) and is sized to receive a portion of pattern control tip (500) when pattern control tip (500) is coupled to mixing chamber (300). Forwardmost compartment (510) also has a sufficient depth to permit pattern control tip (500) to actuate with mixing chamber (300) via main piston (110). Forwardmost compartment (510) may be in fluid communication with mixing chamber compartment (290) or may have separate ports coupling forwardmost compartment (510) with the first set of channels (32). Accordingly, when fluid, such as compressed air, is supplied through inlet (28) and first set of channels (32), the fluid enters mixing chamber compartment (290) and forwardmost compartment (510). The fluid, which may be under substantial pressure, may be forced into impingement holes (310) of mixing chamber (300) to force out or blow out any residual first and/or second source fluids. Additionally, the fluid may be forced through purge channels (508) of pattern control tip (500), as will be described in more detail below.

While various configurations for gun block (200) have been described, still other equally suitable configurations for gun block (200) may be provided as will be apparent to one of ordinary skill in the art in view of the teachings herein.

A. Exemplary Mixing Chamber

FIGS. 5-9 depict an exemplary mixing chamber (300). Mixing chamber (300) comprises a proximal end (302), sides (304), a distal end (306), impingement holes (310) formed within sides (304), a exit hole (320), and a distal tip (330). Proximal end (302) of the present mixing chamber (300) comprises a ball hitch which is inserted into a correspondingly keyed path in piston-chamber link (160). The ball and socket arrangement may permit easier assembly and/or may permit additional freedom of movement of mixing chamber (300) relative to piston-chamber link (160), thereby reducing stress on the coupling of mixing chamber (300) and piston-chamber link (160), though it should be understood that this is merely optional. Proximal end (302) may be coupled to piston-chamber link (160) in a variety of other ways, including integral formation, set screws, threaded attachments, adhesives, clips, pins, expansion pins, or any other suitable attachment such that mixing chamber (300) may be actuated by main piston (110).

Figure 7:
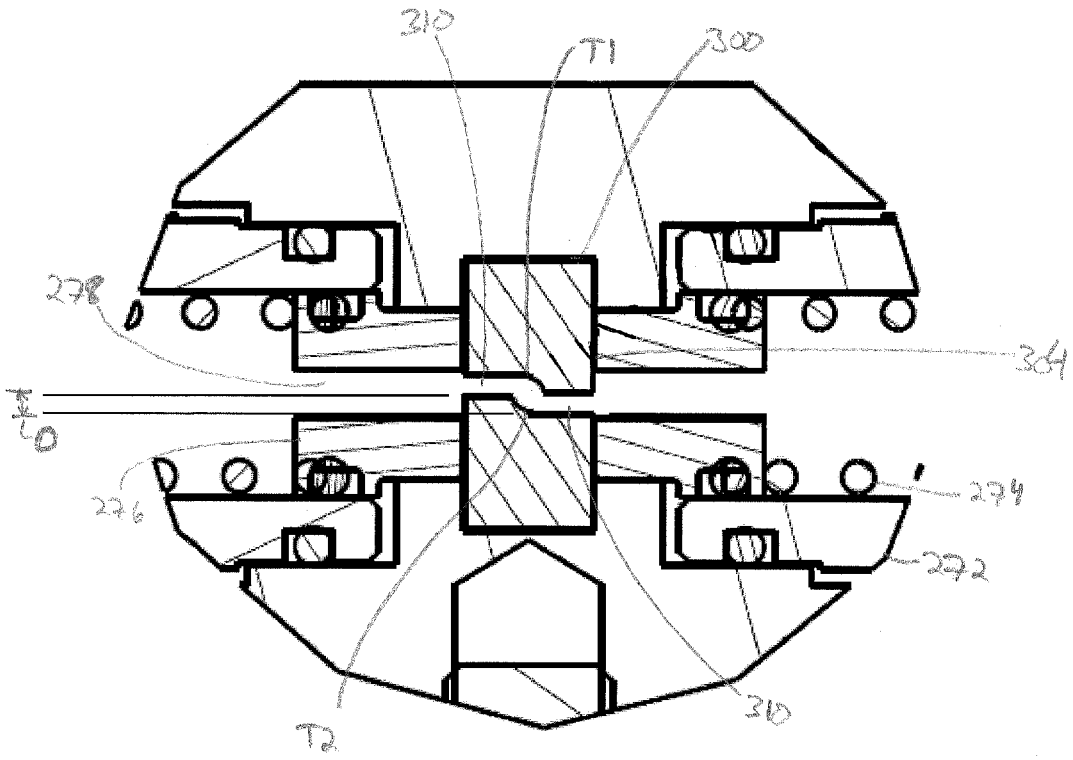
FIG. 7 depicts an enlarged cross-sectional view of the exemplary mixing chamber of FIG. 6.

Exit hole (320) is formed at the distal tip (330) on distal end (304) and extends proximally a preset distance in mixing chamber (300). In the present example, exit hole (320) extends proximally for a depth D until intersecting with impingement holes (310). By way of example only, exit hole (320) depth D may be approximately 0.532 inches from distal tip (330). Exit hole (320) of the present example also comprises a uniform diameter for the entire length of exit hole (320). Exit hole (320) of the present example may have an approximate diameter of 0.0595 inches. Though it should be understood that other equally suitable dimensions for exit hole (320) may be used. Referring now to FIGS. 6-7, impingement holes (310) are perpendicular to exit hole (320), but intersect at an offset O to exit hole (320). In the present configuration, impingement holes (310) are offset such that the impingement holes (310) and exit hole (320) form tangential intersections at points T1 and T2. By way of example only, impingement holes (310) may be offset by approximately 0.034 inches for an impingement hole diameter of approximately 0.041 inches. Though it should be understood that other equally suitable dimensions for impingement holes (310) may be used. Accordingly, in this configuration, when first and second fluid sources enter impingement holes (310), the first and second fluid sources intersect at the proximal end of exit hole (320) at opposite tangential points of exit hole (320), thereby promoting a swirling of the first and second fluid sources within exit hole (320). If the first and second fluid sources are pressurized, the pressure may urge the swirling mixture distally through exit hole (320) toward distal tip (330).

Distal tip (330) of the present example is a cylindrical protrusion from distal end (304) of mixing chamber (300). Distal tip (330) of the present example is configured to couple to pattern control tip (500) such that pattern control tip (500) is secured to distal tip (330). By way of example only, distal tip (330) may comprise threading onto which pattern control tip (500) may be threaded.

Though one exemplary configuration for mixing chamber (300) has been described, as one having ordinary skill in the art will appreciate other suitable configurations for mixing chamber (300) will be apparent when coupled to pattern control tip (500), described in more detail below.

B. Exemplary Pattern Control Tip

Figure 9:
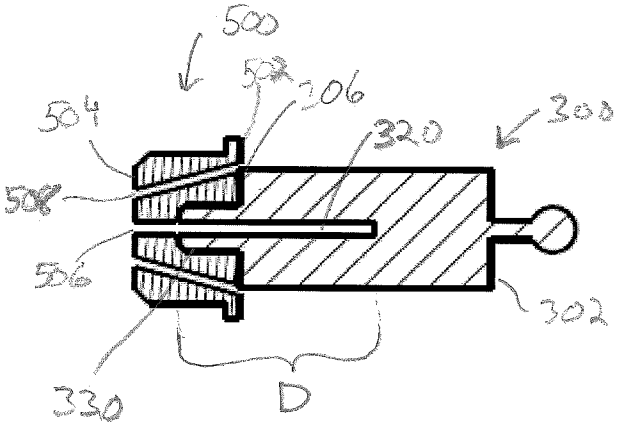
FIG. 9 depicts a side cross-sectional view of the exemplary mixing chamber and pattern control tip of FIG. 8.
Figure 8:
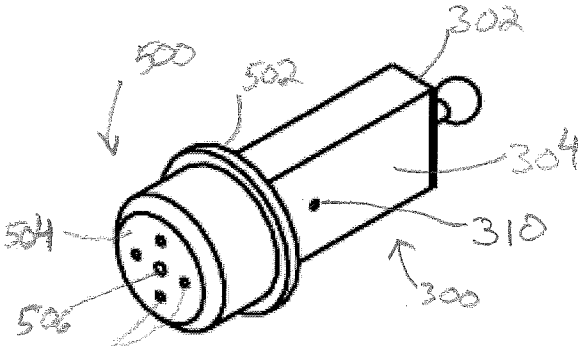
FIG. 8 depicts an isometric view of an exemplary mixing chamber and pattern control tip.

Referring now to FIGS. 5 and 8-9, an exemplary pattern control tip (500) is shown coupled to mixing chamber (300). Pattern control tip (500) of the present example comprises a proximal end (502), a distal end (504), a pattern channel (506), and one or more purge channels (508). Pattern channel (506) may be configured to provide a variety of patterns for spray gun (10) to discharge the mixed fluid out of the distal end. For instance, one merely exemplary pattern channel (506) may comprise a fan pattern generator such that the circular exit hole (320) of mixing chamber (300) couples to a circular aperture at the proximal end of pattern channel (506) of pattern control tip (500). Pattern channel (506) is configured to transition from a circular aperture at the proximal end to a thin, rectangular aperture at the distal end. Such thin, rectangular channel may be horizontal, vertical, or any other suitable orientation relative to spray gun (10). Moreover, the transition from the circular aperture to the thin, rectangular aperture may be made through a series of iterative shapes, each having a constant area substantially equal to the original circular aperture. Alternatively, pattern channel (506) may reduce the area, such that the pressure of the expelled mixed fluid is higher than within mixing chamber (300), or, alternative, pattern channel (506) may increase the area, such that the pressure of the expelled mixed fluid is lower than within mixing chamber (300). Pattern channel (506) may alternatively be a circular aperture for a circular pattern. Pattern channel (506) may increase or decrease in area at distal end (504) for decreased or increased pressure, respectively. Pattern channel (506) may further include other complex patterns, such as a triangle, square, W-shape, an X or cross shape, a ring shape, and/or any other suitable pattern. Moreover, pattern channel (506) may include features to further aid in the mixing of the first and second fluids. For example, pattern channel may comprise veining, step transitions between diameter sizes, obstructions (such as mesh), or any other suitable feature.

Pattern control tip (500) of the present example also comprises one or more purge channels (508) and an o-ring (512) disposed about a portion of pattern control tip (500). As seen best in FIGS. 5 and 9, purge channels (508) are angled channels that angle towards exit hole (320) as purge channels (508) extend from proximal end (502) to distal end (504) of pattern control tip (500). As discussed previously, purge channels (508) are in fluid communication with forwardmost compartment (510) and are configured to receive fluid from inlet (28) when trigger (50) is not depressed. O-ring (512) is configured to substantially form a hermetic seal between pattern control tip (500) and gun block (200) such that forwardmost compartment (510) is sealed. Purge channels (508) of the present example are configured to blow off residual mixed fluid from distal end (504) of pattern control tip (500) as soon as trigger (50) is released, thereby potentially reducing any residual mixed fluids from remaining on pattern control tip (500). For instance, when compressed air is coupled to inlet (28), the compressed air travels through purge channels (508) and pattern channel (506) (via exit hole (320)) to blow off any residual fluids from pattern control tip (500). Thus, the present pattern control tip (500) not only produces a pattern when expelling the mixed fluid from spray gun (10), but the current pattern control tip (500) also cleans distal end (504) of pattern control tip (500) using the compressed fluid to remove any remaining particulates and/or fluids.

Moreover, in the present configuration, pattern control tip (500) is configured to be removably coupled to distal tip (330) such that various pattern control tips may be attached and detached from mixing chamber (300). By way of example only, pattern control tip (500) may be configured to threadably attach to distal tip (330) such that a user need only thread and unthread pattern control tips to change patterns. Still other equally suitable configurations for pattern control tip (500) will be apparent to those of skill in the art in view of the teachings herein.

It should be noted that in the present configuration, pattern control tip (500) (and therefore pattern channel (506)) is substantially shorter in length than exit hole (320) of mixing chamber (300). In this configuration, the first and second fluid sources may begin to mix within mixing chamber (300), though first and second fluid sources may be further mixed at the transition from mixing chamber (300) to pattern control tip (500). Indeed, in one configuration, pattern control tip (500) may have a narrower diameter than mixing chamber (300). In this configuration, first and second fluid sources may turbulently mix at this boundary condition and may remain in a turbulent flow profile (as opposed to a laminar flow profile) over the short distance of pattern control tip (500), thereby potentially promoting the mixture of the two source fluids. Furthermore, the narrowing of diameters may result in a higher pressure to mix the first and second fluid sources. In some alternative configurations, pattern channel (506) may be between 5% and 31% of the combined depth of pattern channel (506) and exit hole (320) having a depth D.

V. Exemplary Interchangeable Handle and Air Manifold

In some versions it may be desirable to use differently shaped handles and/or differently configured air manifolds for a spray gun, such as spray gun (10). Accordingly, the ability to remove and replace a handle and/or air manifold may be desirable. In addition, it may be preferable to be able to remove and replace the handle and/or air manifold without changing other portions of spray gun (10) and/or without purchasing an entirely new spray gun with a different handle. In addition, or in the alternative, in some versions, such interchangeable features may permit spray gun (10) to be mounted to other objects other than handles (e.g., robotic arms, extension poles, etc.). A merely exemplary spray gun (600) having such interchangeability is described below.

Figure 10:
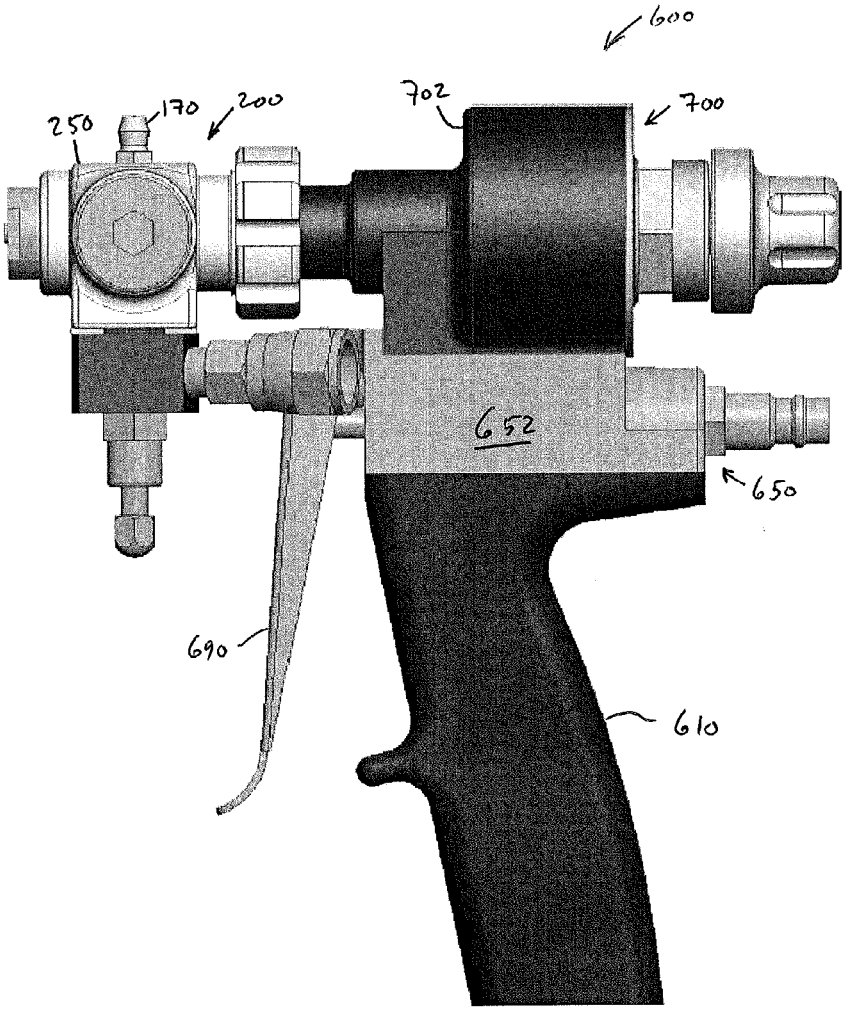
FIG. 10 depicts a side elevation view of an exemplary alternative spray gun.
Figure 11:
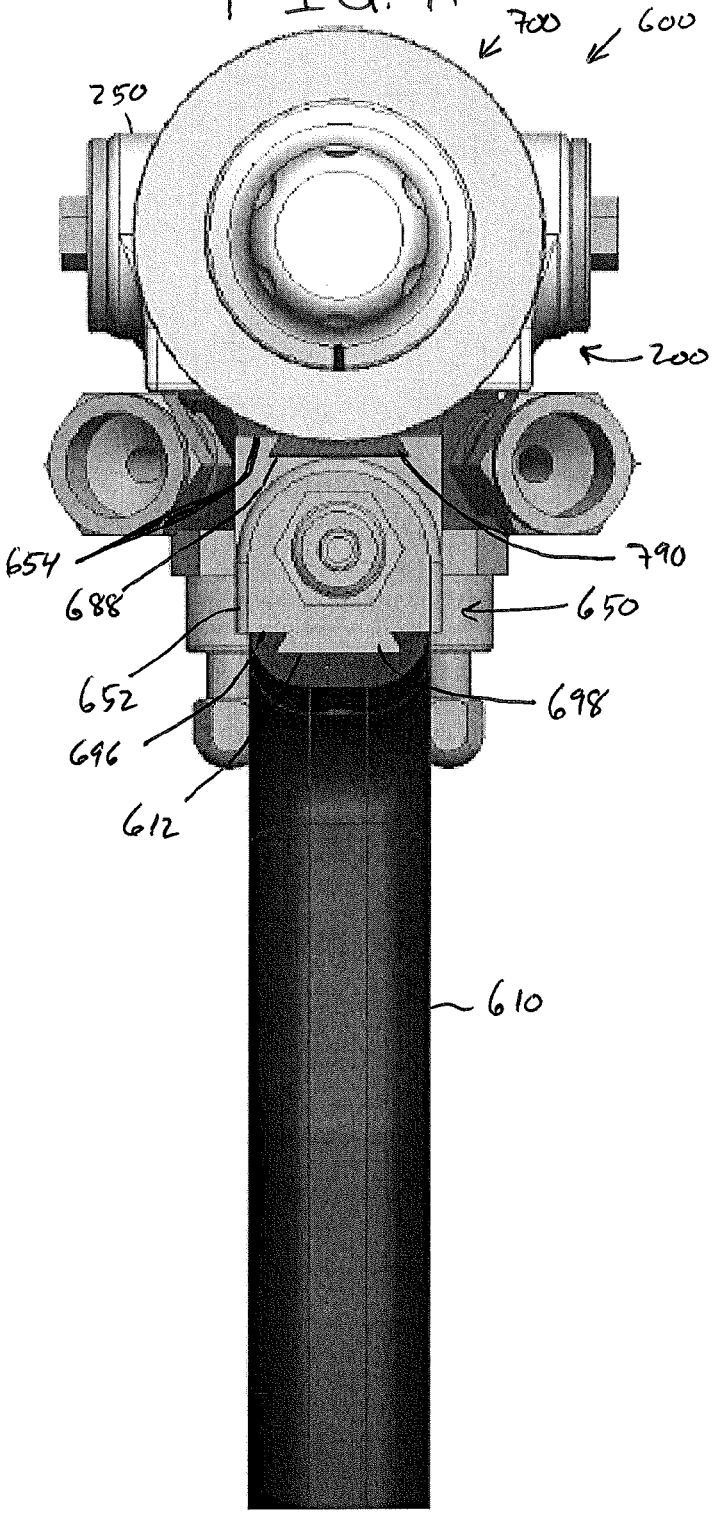
FIG. 11 depicts a rear elevation view of the spray gun of FIG. 10.
Figure 12:
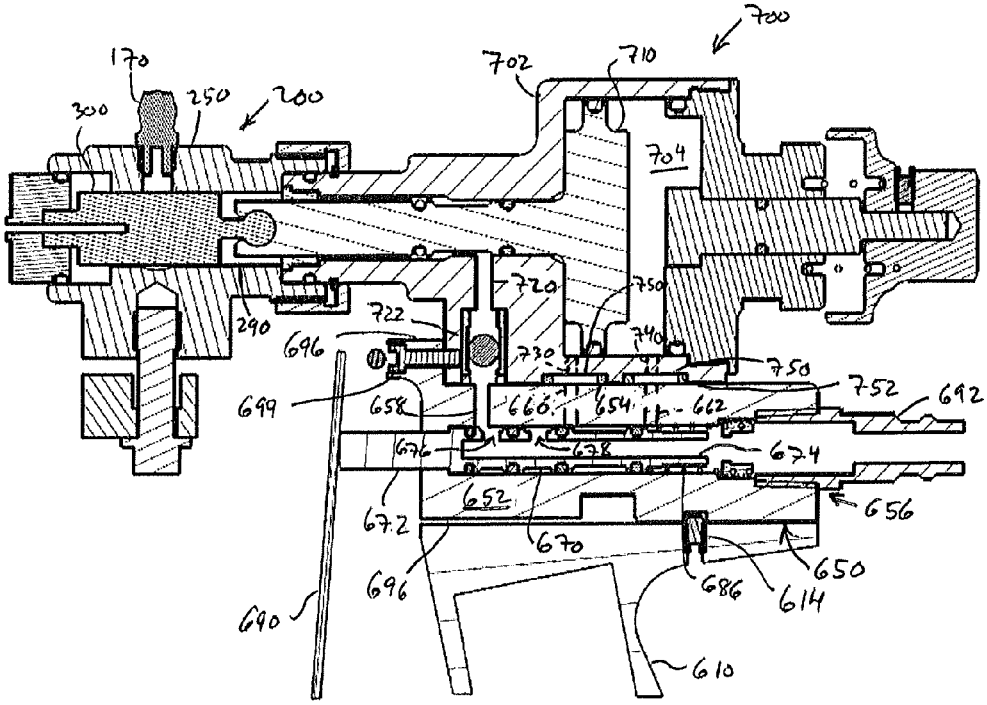
FIG. 12 depicts a longitudinal cross-sectional view of the spray gun of FIG. 10.

FIGS. 10-12 depict spray gun (600) having a handle (610), an air manifold (650), a piston chamber (700), a trigger (690), and gun block (200). Trigger (690) is pivotally coupled to air manifold (650) such that trigger (690) may be pivoted from a first position, in which spray gun (600) is not activated, to a second position, in which spray gun (600) is activated to expel a mixed material. Piston chamber (700) of the present example is mounted above air manifold (650) and is configured to contain a main piston (710) within a piston cavity (704) of a piston chamber body (702) such that main piston (710) is operable to actuate mixing chamber (300) from a first, purging or inactive position, to a second, dispensing position, as described in greater detail above. Gun block (200) extends distally from piston chamber (700) via a coupling of top portion (250) to piston chamber body (702). Gun block (200) may be further constructed in accordance with the teachings above and/or in other manners as will be apparent to one of ordinary skill in the art in view of the teachings herein. It should be noted that, in the present example, zerk fitting (170) is coupled to gun block (200) instead of piston chamber (700), though this is merely optional. Indeed, in some versions zerk fitting (170) may be located opposite to a ball check valve (722), described below, on piston chamber body (702). Such a location may permit easier access to ball check valve (722) by removing zerk fitting (170). In addition, this location of zerk fitting (170) may allow additional grease or other lubricants into piston chamber body (702) to reduce friction between components therein.

As shown in FIG. 12, piston chamber (700) is further configured to be in fluid communication with air manifold (650) via a distal channel (720), a pair of forward channels (730) (shown in phantom), and a pair of rear channels (740) (shown in phantom). Distal channel (720) is in fluid communication with gun block (200) such that fluid provided to distal channel (720) travels through piston chamber (700) to mixing chamber compartment (290), such as that shown in FIGS. 3-4. In the present example, distal channel (720) includes a ball-check valve (722) therein to selectively fluidly seal distal channel (720) when fluid is not flowing through distal channel (720). In addition, ball check valve (722) may substantially prevent foam or other fluids from entering air manifold (650) in the event of an inadvertent crossover of hoses coupled to spray gun (600). Of course it should be understood that valve (722) is merely exemplary and other valves may be used and/or valve (722) may be omitted entirely. Forward channels (730) and rear channels (740) are disposed on either side (forward and rear) of main piston (710) such that a fluid may be forced into piston cavity (704) pressurize the corresponding portion of piston cavity (704) to urge main piston (710) distally or proximally relative to piston chamber body (702). In the present example, forward channels (730) (shown in phantom) and rear channels (740) (also shown in phantom) are disposed within a pair of recesses (750) formed in piston chamber body (702). In the present example, recesses (750) comprise cylindrical recesses though it should be understood that other sizes and/or shapes for recesses (750) may be used. A pair of o-ring seals (752) are each disposed in a corresponding recess (750). Seals (752) are configured to substantially fluidly seal piston chamber body (702) with air manifold (650) when coupled together. Accordingly, fluid, such as air, other gases, water, etc., from air manifold (650) can be communicated into piston chamber (700) to actuate main piston (710) relative to piston chamber body (702). Still other configurations for distal channel (720), forward channels (730) rear channels (740), and/or recesses (750) will be apparent to one of ordinary skill in the art in view of the teachings herein.

Piston chamber body (702) also comprises a longitudinally extending protrusion (790), shown best in FIG. 11, located on a bottom of piston chamber body (702) that is configured to insert into a corresponding channel (688) of air manifold (650), as will be described in greater detail below. In the present example, protrusion (790) comprises a dovetail protrusion (790) that inserts into a corresponding dovetail channel (688), though it should be understood that other slidably joining features may be used as well (e.g., T-shaped joining features, semi-circular joining features, rails, etc.). Protrusion (790) thus permits a user to selectively couple piston chamber (700) to air manifold (650) via slidably coupling protrusion (790) with channel (688). In the present example, air manifold (650) includes a distal stop (696) against which protrusion (790) and/or piston chamber (700) abuts when fully slid onto air manifold (650). In addition, as shown in FIG. 11, distal stop (696) includes a mounting screw (698). Mounting screw (698) threadably couples distal stop (696) to piston chamber body (702) to secure air manifold (650) and piston chamber (700) together. In some versions, other selectively coupleable fasteners may be used instead of mounting screw (698) (e.g., clips, clamps, push-button latches, etc.). Of course it should be understood that, in some versions, mounting screw (698) may be omitted and/or air manifold (650) may be integrally formed with piston chamber (700) such that protrusion (790) may be omitted. Piston chamber (700) may be further configured in accordance with the teachings of piston chamber (100) described above and/or in any other manner as will be apparent to one of ordinary skill in the art in view of the teachings herein.

As noted above, air manifold (650) of the present example is selectively coupleable to piston chamber (700) via protrusion (790) and channel (688). Channel (688) is located on a top surface (654) of a manifold body (652) of air manifold (650) and slidably receives protrusion (790). It should be understood that protrusion (790) and channel (688) cooperatively restrict piston chamber (700) from detaching from air manifold (650) in the vertical direction while permitting horizontal sliding attachment. By way of example only and as noted above, channel (688) comprises a dovetail channel (688) that receives a corresponding dovetail protrusion (790) of piston chamber (700), though it should be understood that other slidably joining features may be used as well (e.g., T-shaped joining features, semi-circular joining features, rails, etc.). In the present example, air manifold (650), comprises manifold body (652), a spool valve (670) that is longitudinally slidable within manifold body (652), and trigger (690) rotatably mounted to manifold body (652) and operable to actuated spool valve (670) relative to manifold body (652).

Manifold body (652) includes a longitudinal opening (656), a distal vertical channel (658), a pair of forward channels (660) (shown in phantom), and a pair of rear channels (662) (shown in phantom). Longitudinal opening (656) of the present example comprises a cylindrical opening that extends through manifold body (652) and receives spool valve (670) therein. As shown in FIG. 12, a distal portion (672) of spool valve (670) extends distally out of longitudinal opening (656) from manifold body (652) to abut and/or otherwise engage with trigger (690), as will be described in more detail below. At a proximal end of longitudinal opening (656), an inlet (692) is coupled to manifold body (652) such that a fluid source may be coupled to inlet (692) to provide fluid into longitudinal opening (656) and/or spool valve (670). Spool valve (670) and/or channels (658, 660, 662) may of course be configured in accordance with at least some of the teachings of spool valve (24) and/or channels (32) described herein or in any other manner as will be apparent to one of ordinary skill in the art in view of the teachings herein.

Distal vertical channel (658) is configured to substantially fluidly couple longitudinal opening (656) with distal channel (720) when air manifold (650) is coupled to piston chamber (700). Forward channels (660) comprise vertical channels extending from longitudinal opening (656), though manifold body (652), to a point on top surface (654) to substantially align with forward channels (730) when air manifold (650) is coupled to piston chamber (700). Likewise, rear channels (662) comprise vertical channels extending from longitudinal opening (656), though manifold body (652), to a point on top surface (654) to substantially align with rear channels (740) when air manifold (650) is coupled to piston chamber (700). Accordingly, it should be understood that channels (660, 662, 730, 740) provide fluid communication between piston cavity (704) and longitudinal opening (656). Thus, when spool valve (670) is in a corresponding position, described in more detail below, fluid from a fluid source coupled to longitudinal opening (656) is communicated to piston cavity (704) via a corresponding set of channels (660, 662, 730, 740) to actuate main piston (710) within piston cavity (704). Similarly, distal channels (658, 720) provide fluid communication between mixing chamber compartment (290) of gun block (200) and longitudinal opening (656). Accordingly, when spool valve (670) is in a first position, such as that shown in FIG. 12, fluid from a fluid source coupled to longitudinal opening (656) is communicated to mixing chamber compartment (290) via distal channels (658, 720) to purge or otherwise provide fluid to components of gun block (200). Of course other configurations to fluidly couple longitudinal opening (656) with piston cavity (704) and/or mixing chamber compartment (290) will be apparent to one of ordinary skill in the art in view of the teachings herein.

Spool valve (670) of the present example is actuatable relative to manifold body (652) via trigger (690). As noted above, a distal portion (672) of spool valve (670) engages with trigger (690) such that trigger (690) is operable to actuate spool valve (670) relative to manifold body (652). Spool valve (670) comprises a longitudinal cylindrical member having a longitudinal channel (674) and a pair of transverse channels (676, 678). Longitudinal channel (674) begins at a proximal end of spool valve (670) and terminates prior to distal portion (672). Transverse channels (676, 678) extend transversely from longitudinal channel (674) to a pair of openings on an outer surface of spool valve (670) such that fluid may travel from the proximal opening of longitudinal channel (674) to the openings. A plurality of o-rings are disposed about spool valve (670) to fluidly isolate openings relative to each other and to substantially fluidly seal spool valve (670) when spool valve (670) is within longitudinal opening (656). In the present example, a spring (686) biases spool valve (670) distally relative to manifold body (652). Of course other valves and/or configurations for spool valve (670) will be apparent to one of ordinary skill in the art in view of the teachings herein.

In addition, a bottom surface (696) of air manifold (650) comprises a second protrusion (699) (shown best in FIG. 11) to selectively couple to a second channel (612) formed in handle (610). Accordingly, it should be understood that air manifold (650) and handle (610) are configured to selectively attach and detach. In some versions, a locking feature (614), such as a pin, clip, clamp, screw, bolt, and/or other feature, can be provided to longitudinally secure handle (610) relative to air manifold (650). In the present example, a set screw is provided as locking feature (614) to secure handle (610) to air manifold (650). Of course locking feature (614) is merely optional. Thus, a variety of handles (610) can be coupled to air manifold (650). For instance, a short handle may be used for using gun (600) in tight spaces. Alternatively, a long handle may be used for other operations. Further still, an adapter may be coupled to second protrusion (699) to mount gun (600) to a stick (such as to reach far distances with gun) or other device. Moreover, handles (610) may be custom made to fit a user's hand and/or may come in a variety of shapes to accommodate different user's hand sizes. Such handles (610) may be cast, injection molded, or otherwise formed. Still further variations for handle (610) or other components which may couple to second protrusion (699) will be apparent to one of ordinary skill in the art in view of the teaching herein.

Spray gun (600) operates in a similar manner as spray gun (10) described above. Initially, when trigger (690) in a first position, spool valve (670) is in a first position, shown in FIG. 12, to fluidly couple inlet (692) with distal channels (658, 720) via transverse channel (676) such that the fluid travels through a flow path in spray gun (600) to mixing chamber compartment (290). Accordingly, when fluid, such as compressed air, is supplied through inlet (692), the fluid enters mixing chamber compartment (290) to force or blow out any residual first and/or second source fluids, such as in the manner described above. In addition, fluid is provided to rear channels (662, 740) via longitudinal opening (656) (travelling around a proximal end of spool valve (670)) such that main piston (710) is urged distally within piston cavity (704). It should be understood that, in the present position, forward channels (660, 730) are fluidly isolated via o-rings (684) relative to the fluid source coupled to inlet (692). When trigger (690) is actuated to a second position, spool valve (670) is actuated proximally to a second position (e.g., slide proximally within longitudinal opening (656)) such that distal channels (658, 720) are substantially fluidly sealed via o-rings (684) from inlet (692). It should be understood that rear channels (662, 740) are also substantially fluidly sealed via o-rings (684) from inlet (692). In this position, transverse channel (678) substantially aligns with forward channels (660, 730) such that fluid provided via inlet (692) urges main piston (710) proximally within piston cavity (704), thereby actuating mixing chamber (300) within gun block (200). As described in greater detail above, pressurized fluids coupled to gun block (200) are then mixed and expelled from spray gun (600). Of course other configurations for trigger (690), spool valve (670), and/or spray gun (600) will be apparent to one of ordinary skill in the art in view of the teachings herein.

It should be appreciated that any patent, publication, or other disclosure material, in whole or in part, that is said to be incorporated by reference herein is incorporated herein only to the extent that the incorporated material does not conflict with existing definitions, statements, or other disclosure material set forth in this disclosure. As such, and to the extent necessary, the disclosure as explicitly set forth herein supersedes any conflicting material incorporated herein by reference. Any material, or portion thereof, that is said to be incorporated by reference herein, but which conflicts with existing definitions, statements, or other disclosure material set forth herein will only be incorporated to the extent that no conflict arises between that incorporated material and the existing disclosure material.

Having shown and described various embodiments of the present invention, further adaptations of the methods and systems described herein may be accomplished by appropriate modifications by one of ordinary skill in the art without departing from the scope of the present invention. Several of such potential modifications have been mentioned, and others will be apparent to those skilled in the art. For instance, the examples, embodiments, geometrics, materials, dimensions, ratios, steps, and the like discussed above are illustrative and are not required. Accordingly, the scope of the present invention should be considered in terms of the following claims and is understood not to be limited to the details of structure and operation shown and described in the specification and drawings.

I claim:

1. An apparatus comprising:

(a) a main piston chamber having a main piston disposed therein, wherein the main piston is actuatable relative to the main piston chamber;

(b) a gun block extending from the main piston chamber, wherein the gun block comprises:

i. a top portion having a mixing chamber compartment formed therein, ii. a mixing chamber coupled to the main piston, wherein the mixing chamber is actuatable relative to the top portion, wherein the mixing chamber comprises:

A. an exit hole extending longitudinally from an end point within the mixing chamber to a distal end of the mixing chamber, B. a first impingement hole, wherein the first impingement hole extends from a first side of the mixing chamber to the exit hole, wherein the first impingement hole has a first axis, wherein the first axis is axially offset from an exit axis of the exit hole, wherein a first sidewall of the first impingement hole tangentially intersects with an exit side wall of the exit hole at a first point, and C. a second impingement hole, wherein the second impingement hole extends from a second side of the mixing chamber to the exit hole, wherein the second impingement hole has a second axis, wherein the second axis is axially offset from the exit axis of the exit hole, wherein a second sidewall of the second impingement hole tangentially intersects with the exit sidewall of the exit hole at a second point, and iii. a tip coupled to the distal end of the mixing chamber, wherein the tip comprises a pattern exit hole and a pattern channel, wherein the pattern channel has a pattern channel axis;

(c) a fluid inlet, wherein the fluid inlet is in selective fluid communication with the mixing chamber via a fluid channel, wherein the fluid channel includes a check valve positioned between the fluid inlet and the mixing chamber, wherein the pattern channel axis is coaxial with the exit axis, wherein the pattern channel has a first length, wherein the exit hole has a second length, wherein the second length is greater than the first length.

2. The apparatus of claim 1 wherein the first length and the sum of the first length and the second length form a ratio, wherein the ratio is less than approximately 31%, inclusive.

3. The apparatus of claim 1 wherein the first length and the sum of the first length and the second length form a ratio, wherein the ratio is between 31%, inclusive, and 5%, inclusive.

4. The apparatus of claim 1 wherein the first length and the sum of the first length and the second length form a ratio, wherein the ratio is 5%.

5. The apparatus of claim 1 comprising a trigger, wherein the trigger is operable to selectively actuate the main piston.

6. The apparatus of claim 1 wherein the gun block comprises a first inlet and a second inlet, wherein the first inlet is in selective fluid communication with the first impingement hole, and wherein the second inlet is in selective fluid communication with the second impingement hole.

7. The apparatus of claim 6 wherein the gun block comprises a bottom portion coupled to the top portion, wherein the first inlet and the second inlet are associated with the bottom portion.

8. The apparatus of claim 1 wherein the main piston is actuatable from a first position to a second position, wherein the first impingement hole and the second impingement hole of the mixing chamber are in fluid communication with the mixing chamber compartment when the main piston is in the first position, and wherein the first impingement hole and the second impingement hole of the mixing chamber are substantially fluidly isolated from the mixing chamber compartment when the main piston is in the second position.

9. The apparatus of claim 8, wherein the fluid inlet is in fluid communication with the mixing chamber when the main piston is in the first position.

10. The apparatus of claim 9, wherein the fluid inlet is substantially fluidly isolated from the mixing chamber when the main piston is in the second position.

11. The apparatus of claim 10 wherein the tip comprises a purge channel, wherein the purge channel is in fluid communication with the mixing chamber compartment.

12. The apparatus of claim 8 wherein the top portion comprises a first compression valve, wherein the first compression valve is operable to selectively fluidly couple a first inlet with the first impingement hole of the mixing chamber when the main piston is in the second position.

13. The apparatus of claim 1 comprising a handle, wherein the handle is selectively coupled to the main piston chamber.

14. The apparatus of claim 13 wherein the handle comprises a recess, wherein the main piston chamber comprises a protrusion, wherein the recess and protrusion form a dovetail joint.

15. The apparatus of claim 1 comprising an air manifold, wherein the air manifold is selectively coupled to the main piston chamber, wherein the air manifold comprises a spool valve disposed therein, wherein the spool valve is selectively actuated by a trigger pivotably coupled to the main piston chamber, wherein the spool valve is operable to selectively fluidly couple the fluid inlet with the main piston chamber and the mixing chamber compartment.

16. A spray assembly for a spray gun comprising:

(a) a mixing chamber comprising:

i. an exit hole extending longitudinally from an end point within mixing chamber to a distal end of the mixing chamber, ii. a first impingement hole, wherein the first impingement hole extends from a first side of the mixing chamber to the exit hole, wherein the first impingement hole has a first axis, wherein the first axis is axially offset from an exit axis of the exit hole, wherein a first sidewall of the first impingement hole tangentially intersects with an exit side wall of the exit hole at a first point, and iii. a second impingement hole, wherein the second impingement hole extends from a second side of the mixing chamber to the exit hole, wherein the second impingement hole has a second axis, wherein the second axis is axially offset from the exit axis of the exit hole, wherein a second sidewall of the second impingement hole tangentially intersects with the exit sidewall of the exit hole at a second point; and (b) a tip coupled to the distal end of the mixing chamber, wherein the tip comprises a purge channel, a pattern exit hole, and a pattern channel, wherein the pattern channel has a pattern channel axis;

wherein the pattern channel axis is coaxial with the exit axis, wherein the pattern channel has a first length, wherein the exit hole has a second length, wherein the second length is greater than the first length;

(c) a fluid source, wherein the fluid source is in communication with the exit hole of the mixing chamber and the purge channel of the tip; and (d) a trigger, wherein the trigger is operable to actuate the mixing chamber and the fluid source, wherein the mixing chamber is operable to transition between a spraying configuration and a non-spraying configuration, wherein the fluid source is operable to transition between a purging configuration and a non-purging configuration in response to actuation of the trigger, wherein the non-spraying configuration of the mixing chamber corresponds to the purging configuration of the fluid source, wherein the trigger is biased to maintain the fluid source in the purging configuration.

17. The apparatus of claim 16 wherein the first length and the sum of the first length and the second length form a ratio, wherein the ratio is between 31%, inclusive, and 5%, inclusive.

18. The apparatus of claim 16 wherein the mixing chamber comprises a distal tip, wherein the tip couples to the distal tip.

19. The apparatus of claim 16, wherein the purge channel is operable to displace material surrounding the pattern exit hole when a pressurized fluid is in fluid communication with a proximal end of the purge channel via the fluid source.

20. A spray gun comprising:

(a) a main piston chamber having a main piston disposed therein, wherein the main piston is actuatable relative to the main piston chamber;

(b) a gun block extending from the main piston chamber, wherein the gun block comprises:

i. a top portion having a mixing chamber compartment formed therein, ii. a mixing chamber coupled to the main piston, wherein the mixing chamber is actuatable relative to the top portion, wherein the mixing chamber comprises:

A. an exit hole extending longitudinally from an end point within mixing chamber to a distal end of the mixing chamber, B. a first impingement hole, wherein the first impingement hole extends from a first side of the mixing chamber to the exit hole, wherein the first impingement hole has a first axis, wherein the first axis is axially offset from an exit axis of the exit hole, wherein a first sidewall of the first impingement hole tangentially intersects with an exit side wall of the exit hole at a first point, and C. a second impingement hole, wherein the second impingement hole extends from a second side of the mixing chamber to the exit hole, wherein the second impingement hole has a second axis, wherein the second axis is axially offset from the exit axis of the exit hole, wherein a second sidewall of the second impingement hole tangentially intersects with the exit sidewall of the exit hole at a second point, iii. a first inlet, wherein the first inlet is in selective fluid communication with the first impingement hole, iv. a second inlet, wherein the second inlet is in selective fluid communication with the second impingement hole, and v. a tip coupled to the distal end of the mixing chamber, wherein the tip comprises a pattern exit hole and a pattern channel, wherein the pattern channel has a pattern channel axis, wherein the pattern channel axis is coaxial with the exit axis, wherein the pattern channel has a first length, wherein the exit hole has a second length, wherein the first length and the sum of the first length and the second length form a ratio, wherein the ratio is between approximately 31%, inclusive, and approximately 5%, inclusive;

(c) a trigger, wherein the trigger is operable to selectively actuate the main piston; and (d) a handle, wherein the handle is selectively coupled to the main piston chamber.

* * * * *